United States Patent [19]

Paton et al.

[11] Patent Number: 4,966,222

[45] Date of Patent: Oct. 30, 1990

[54] METHOD OF AND APPARATUS FOR PRODUCING SHAPED CASTINGS

[76] Inventors: Boris E. Paton, ulitsa Chkalova, 41, kv. 26; Boris I. Medovar, ulitsa A.Barbjusa, 22/26, kv. 109; Jury V. Orlovsky, ulitsa Postysheva, 5, kv. 25; Vitaly V. Lupan, ulitsa Naumova, 19, kv. 153; Vladimir Y. Maidannik, bulvar L.Ukrainki, 19, kv. 266; Grigory B. Schupak, ulitsa Chudnovskogo, 7, kv. 74; Jury Y. Chernyavsky, bulvar L.Ukrainki, 8, kv. 56; Alexei G. Bogachenko, Sapernoe pole, 26a, kv. 30; Alexandr N. Kozhushko, ulitsa Stalskogo, 16a, kv. 38, all of Kiev, U.S.S.R.

[21] Appl. No.: 417,737

[22] Filed: Oct. 5, 1989

[51] Int. Cl.[5] ..... B22D 23/00; B22D 41/04

[52] U.S. Cl. ..... 164/136; 164/336; 164/497; 164/515

[58] Field of Search ..... 164/136, 495, 497, 515, 164/336

[56] References Cited

U.S. PATENT DOCUMENTS

| | | | |
|---|---|---|---|
| 1,734,313 | 11/1929 | von Malmborg | 164/336 |
| 1,926,573 | 9/1933 | Willcox | 164/336 X |
| 1,961,063 | 5/1934 | Miguet et al. | 164/136 |
| 2,195,960 | 4/1940 | Morris | 164/336 |
| 2,411,176 | 11/1946 | Wessel | 164/336 X |
| 2,429,145 | 10/1947 | Wessel | 164/336 X |
| 2,897,555 | 8/1959 | Nishikiori | 164/136 X |
| 3,333,625 | 8/1967 | Fromson | 164/136 |

FOREIGN PATENT DOCUMENTS

| | | | |
|---|---|---|---|
| 268450 | 9/1970 | U.S.S.R. | 164/336 |
| 763035 | 9/1980 | U.S.S.R. | 164/336 |
| 656350 | 12/1981 | U.S.S.R. . | |
| 903215 | 8/1962 | United Kingdom | 164/336 |

*Primary Examiner*—Richard K. Seidel
*Assistant Examiner*—J. Reed Batten, Jr.
*Attorney, Agent, or Firm*—Lilling & Lilling

[57] ABSTRACT

The method consists in that molten metal and slag are obtained in a reservoir and then are poured into a mold and kept there till crystallization of the metal takes place and a shaped casting is produced. Prior to the process of pouring, the mold is moved towards the reservoir so that their upper end faces adjoin each other to form a closed integrated unit, which is turned in a vertical plane to transfer the metal and slag into the mold. The joint of the mold with the reservoir in the process of pouring is tightened by providing a time delay for this process from the moment of covering the joint with a slag layer till the moment of solidification of this layer. In the device for producing the castings, the mold and reservoir are provided with individual drives rotating them in a vertical plane, the drives moving the mold to form a closed integrated unit with the reservoir and rotating this unit in the process of pouring the molten metal and slag into the mold.

7 Claims, 2 Drawing Sheets

METHOD OF AND APPARATUS FOR PRODUCING SHAPED CASTINGS

Field of the Invention

The present invention relates to electroslag technology and, more particularly, to a method for producing shaped castings in a mold and to a device for carrying this method into effect.

The present invention is based on a method of electroslag mold casting and is intended mainly for producing, under workshop and field conditions, shaped castings of components and tools of ferrous and nonferrous metals having mechanical properties of forgings and a configuration nearly identical to that of the final product.

DESCRIPTION OF THE PRIOR ART

Known in the art is a method of producing shaped castings (SU, A, 548149), in which molten metal with slag used in the process of smelting is poured into a mold in the form of an open jet. This method does not provide integrity of the jet of electroslag metal being poured from the reservoir into the mold, since metal poured in the form of an open jet is in contact with the atmosphere and, as a result, is saturated with metal inclusions deteriorating the casting quality.

Also known in the art is a method of producing, shaped castings in a mold (US, A, 3,333,625), in which molten metal is obtained in a reservoir, whereupon this metal is poured into a mold. The reservoir and the mold are rigidly connected to each other so that the mold wall, along which the metal and slag flow, is in fact an extension of the reservoir wall, while the upper end faces of the mold and reservoir are spaced from one another. In this case the mold and reservoir form an integrated unit open at one side, while pouring of molten metal and slag is effected by turning this unit about a horizontal axis.

However, the technological possibilities of the prior art method are limited. For example, a fast turn of the open integrated unit, containing molten metal and slag, about a horizontal axis in the process of pouring can lead to spillage of metal and slag. Slow rotation of the open integrated unit results in solidification of a considerable amount of slag on the wall connecting the mold and the reservoir so that the casting in the mold will have surface defects. Furthermore, the casting head cannot effectively be heated in the open reservoir-mold unit, which either leads to formation of blow holes and other casting defects or makes it necessary to use a conciderable amount of flux to avoid such defects.

Known in the art is a furnace for electroslag remelting (SU, A, 606,359) comprising a column, an upper carriage with an electrode fixed thereon, a reservoir for molten metal and slag mounted in rotary bearings, a bracket and a lower carriage. The reservoir body is connected to the upper carriage by means of a flexible member, and an individual mold is used for making a shaped casting. After an appropriate amount of molten metal and slag has been introduced, the reservoir is rotated in the bearings while poured simultaneously into the mold are molten metal and slag.

Known in the art is an apparatus for mold casting (SU, A, 656,350) comprising a reservoir for molten metal and slag and a feed mechanism for electrodes. The reservoir is made in the form of a conical tank with a top pointing downwards and can be rotated by an individual drive. The reservoir and the drive are mounted on a platform, which can be rotated in a vertical plane by another drive. After molten metal and slag have been introduced into the reservoir, the latter rotates in a vertical plane together with the platform. In doing so, metal and slag are being poured into a separately standing mold.

The known devices do not provide continuity of the jet of electroslag metal since pouring is effected onto separately standing molds using an open jet.

Known in the art is a device for producing a shaped casting comprising a reservoir for molten metal and slag, which is provided with a drive to rotate the reservoir in a vertical plane about a horizontal pivot bearing, and a mold rigidly secured to the reservoir during the whole process of accumulation and pouring of the electroslag metal (B.E. Paton, B. I. Medovar, Yu. V. Orlovsky "Elektroshlakovoe lokalnoe litye" (Local Electroslag Casting), 1982. "Znanie USSR" Publishers (Kiev), p.p. 51–53).

Since the molten metal spout of the reservoir mounted on its casing is in fact an extension of the mold wall, the jet of electroslag metal poured from the reservoir into the mold is not broken and molten metal is always under the slag layer, which prevents its contact with the atmosphere and provides high quality of the ingot.

However, this prior art device features low efficiency due to the fact that for the period of cooling the cast ingot and replacing of the filled mold with an empty one, the reservoir is in a turned-over position and cannot be used for reception of the next portion of metal.

The time loss for cooling the large-size castings may amount up to 50% of the useful time spent for the molten metal accumulation and pouring.

SUMMARY OF THE INVENTION

An object of the present invention is to provide a method of producing shaped castings in a mold and eliminating any spillage of molten metal and slag when these are being poured into the mold.

Still another object of the invention is to provide effective heating of the casting head in the process of crystallization of the cast ingot, while reducing the amount of flux needed for this purpose.

Another object of the invention is to provide a device for producing shaped castings in a mold which makes it possible to obtain a next portion of molten metal and slag in the reservoir until the mold with a cast ingot is replaced by a fresh mold.

Yet another object of the invention is to increase the device efficiency.

These and other objects are attained by providing a method of producing shaped castings in a mold, in which molten metal and slag are obtained in a reservoir, poured into a mold and kept there till they are crystallized and a final shaped cast ingot is produced therein. According to the invention, prior to pouring molten metal, the mold is installed above the reservoir so that their upper end faces adjoin each other. Molten metal and slag are poured from the reservoir into the mold while turning the mold and reservoir to a position, in which the mold is located above the reservoir. In the process of pouring molten metal and slag from the reservoir into the mold the joint of their upper faces in the molten metal transfer zone is tightly sealed.

It is advisable that the joint of the upper faces of the mold and reservoir in the zone of transfer of molten metal and slag into the mold is sealed by delaying the process of pouring from the moment of closing the joint by a slag layer in the pouring zone to the moment of solidification of this slag layer.

It is preferable that the time delay of the pouring of molten metal and slag is not less than 2% of the total duration of the pouring.

It is expedient that the slag layer covering the joint of the upper end faces of the mold and reservoir is forcedly cooled.

It is also expedient that the reservoir is kept on the mold till complete crystallization of the casting.

The essence of the invention consists also of a device for producing shaped castings in a mold comprising a reservoir for molten metal and slag, having a drive for turning the reservoir in a vertical plane, and a mold. According to the invention, the mold is mounted with a possibility of moving towards the reservoir until their upper end faces adjoin and form a closed integrated unit rotatable in the vertical plane by the reservoir drive.

It is expedient that the mold and reservoir for molten metal and slag are mounted on a common pivot bearing and provided with an individual drive for rotating the mold in a vertical plane.

In another embodiment of the invention it is preferable that the reservoir for molten metal and slag is pivotally mounted between two bearings and can occupy two positions, in one of which it is connected to one bearing and in the other position it is connected to the other bearing; in this case there is provided at least one additional mold mounted on an individual pivot bearing and provided with a drive for rotation of the mold in a vertical plane, said mold forming together with the reservoir in one of its positions an integrated unit adapted to be rotated in a vertical plane by the additional mold drive.

It is desirable that the reservoir for molten metal and slag and each mold are provided with at least one automatic coupling element operating when the upper end faces adjoin each other.

The proposed invention makes it possible to enhance the quality of the shaped castings by eliminating blow holes and other casting defects. This is attained by changing the succession of steps comprising the method and providing the reservoir and mold with individual drives whereby spillage of metal poured into the mold is eliminated. The present invention also makes it possible to reduce the time of producing a final cast ingot and to increase the device efficiency approximately by 20% due to additional cooling of the slag layer poured into the mold and due to the fact that the reservoir is returned to its initial position for accumulation of a next portion of molten metal and slag prior to the moment of final crystallization of the casting in the mold. Furthermore, the invention makes it possible to improve the process economy by using the radiant energy of the inner surface of the reservoir for heating the casting head.

BRIEF DESCRIPTION OF THE DRAWINGS

The invention is further described by way of example with reference to the accompanying drawings, in which.

DETAILED DESCRIPTION OF THE INVENTION

Figure 1:
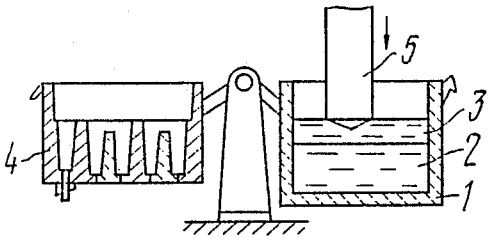
FIG. 1 shows the initial step of effecting the method of producing shaped castings in a mold, in which molten metal and slag are produced, according to the invention.
Figure 2:
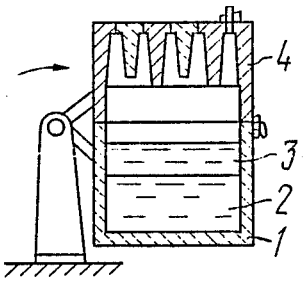
FIG. 2 shows the second step of effecting the method, in which the upper end face of the mold adjoins the upper end face of the reservoir to form a closed integrated unit, according to the invention.
Figure 3:
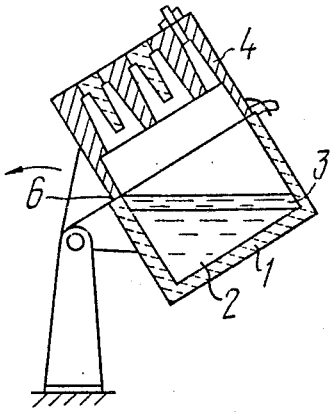
FIG. 3 shows the process of delaying the step of pouring molten metal and slag from the reservoir into the mold, when the slag layer covers the joint of the upper end faces of the mold and reservoir in the zone of overflow of metal with slag, according to the invention.
Figure 4:
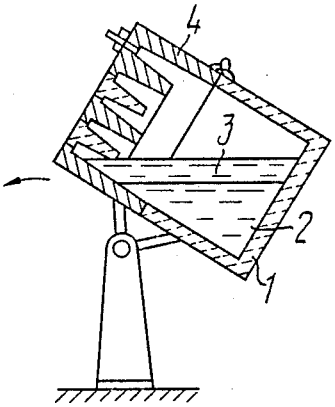
FIG. 4 shows the process of pouring metal with slag after solidification of the slag layer at the joint of the upper end faces of the mold and reservoir in the molten metal transfer zone, according to the invention.

The proposed method of producing shaped castings in a mold is better understood from FIGS. 1 to 5, which illustrate the steps of carrying the method into effect. The following reference numerals are accepted in these figures: 1 is a reservoir for molten metal 2 and slag 3; 4 is a mold; 5 is a consumable electrode; 6 is a joint of the mold 4 and the reservoir 1 in a zone of transfer of the metal 2 with the slag 3 into the mold 4; 7 is a final shaped casting; 8 is a casting head; 9 is energy radiated by the inner surface 10 of the reservoir 1.

The proposed method of producing shaped castings in a mold consists in the following. At the beginning of the working cycle, when the upper end faces of the reservoir 1, and the mold 4 are turned relative to each other through an angle of 180°, the molten metal 2 and the slag 3 are obtained in the reservoir 1, e.g. by means of electroslag remelting of the consumable electrode 5. Then the mold 4 (FIG. 2) is moved towards the reservoir 1 and is installed so that the upper end faces of the mold 4 and the reservoir 1 adjoin each other. Then the molten metal 2 with the slag 3 is poured into the mold 4 by simultaneously turning the mold 4 and the reservoir 1 to a position, where the mold 4 (FIG. 3) is arranged under the reservoir 1. To prevent spillage of the molten metal 2 and the slag 3, the joint 6 of the mold 4 and the reservoir 1 in the zone of transfer of the molten metal 2 with the slag 3 is tightly sealed, e.g. by delaying the process of pouring. The rotation of the mold 4 with the reservoir 1 is stopped when the layer of the slag 3 covers the joint 6 in the zone of transfer of the molten metal 2 with slag 3. The mold 4 with the reservoir 1 is kept in this position till the layer of the slag 3 in the transfer zone solidifies. The process of solidification of the slag 3 at the joint 6 is monitored, e.g. by means of a thermocouple.

The time of delaying the process of pouring must be equal to at least 2% of the total time of the pouring process. If the pouring delay time is shorter than that mentioned above, spillage of the molten metal 2 and the slag 3 will take place since during this period of time the layer of the slag 3 filling the joint 6 in the transfer zone is still soft.

To reduce the time of solidification of the slag 3, its layer at the joint 6 is forcedly cooled, e.g. by blowing cold air or by contact with cooling water.

The gap at the joint 6 can also be sealed by glueing an asbestos cord or by doubing the joint 6 with a mixture of magnesite powder and liquid glass.

Figure 5:
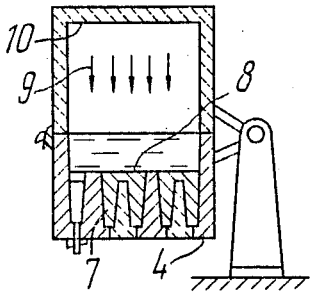
FIG. 5 shows the final step of pouring molten metal and slag with a casting being crystallized in the mold while the casting heat is heated by a radiant energy radiated by the inner surface of the reservoir, according to the invention.

After the slag 3 has been solidified (FIG. 4), the pouring is continued until the molten metal 2 and slag 3 are completely transferred to the mold 4 and form a casting 7 (FIG. 5). The casting head 8 of the casting 7 is additionally heated by the radiant energy 9 radiated by the inner surface 10 of the reservoir 1 to prevent formation of blow holes and other casting defects. For this purpose, the reservoir 1 is kept on the mold 4 till the complete crystallization of the casting 7. The additional heating of the casting head 8 of the casting 7 allows one to reduce the amount of flux used for production of slag heating the casting head 8 of the casting 7 thus improving the economy of the casting process. The end of the crystallization of the casting 7 is monitored, e.g. by means of a thermocouple built into the wall of the mold 4. When the crystallization is over, the reservoir 1 (FIG. 1) is returned to its initial position to receive a next portion of the molten metal 2 and the slag 3, while the mold 4 with the casting 7 is replaced with an empty mold.

Figure 6:
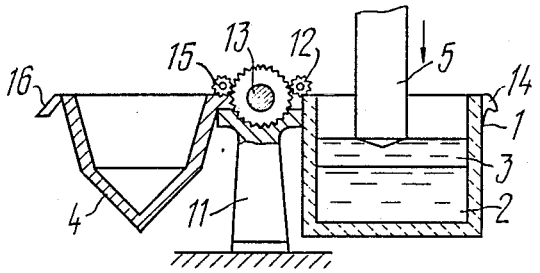
FIG. 6 is a general view of an embodiment of the device for producing shaped castings in a mold at the beginning of the working cycle, according to the invention.

The device for producing shaped castings in a mold, according to the invention, comprises the reservoir 1 (FIG. 6) for the molten metal 2 and the slag 3, the mold 4, and the consumable electrode 5 used for producing the molten metal and slag.

The reservoir 1 and the mold 4 are mounted on a common pivot bearing 11 disposed therebetween. The reservoir 1 is provided with an individual drive 12 for turning the reservoir about a center point 13 of the common pivot bearing 11 and elements 14 made in the form of brackets and used for automatic coupling of the reservoir 1 with the mold 4. The mold 4 is provided with an individual drive 15 for turning it about the center point 13 of the common pivot bearing 11 and with elements 16 used for coupling the mold to the reservoir 1 and made in the form of clamps.

Figure 7:
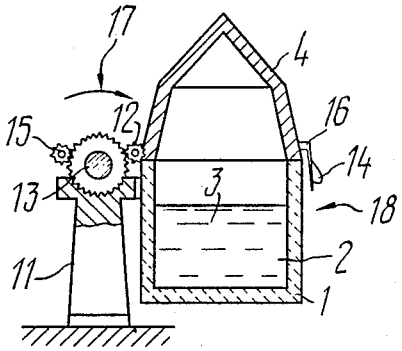
FIG. 7 shows a mutual position of the reservoir for molten metal and slag and the mold at the moment of forming the closed integrated unit, according to the invention.

The arrow 17 in FIG. 7 shows the direction of rotation of the mold 4 until its upper end face adjoins the upper end face of the reservoir 1 to form a closed integrated unit 18.

Figure 8:
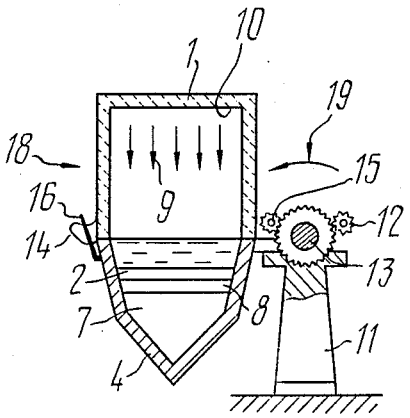
FIG. 8 shows a mutual position of the reservoir for molten metal and slag and the mold at the moment of finishing the pouring of molten metal and slag into the mold, according to the invention.

The arrow 19 in FIG. 8 shows the direction of rotation of the closed integrated unit 18 by the drive 12 of the reservoir 1 when pouring the molten metal 2 and the slag 3 into the mold 4 to produce a casting 7.

Adjoining of the end faces of the reservoir 1 and mold 4 can be effected not only by turning the mold 4 in a vertical plane but by using any other method, e.g. by moving the mold along appropriate guides or by lowering it onto the reservoir 1 with the help of a hoisting mechanism.

Figure 9:
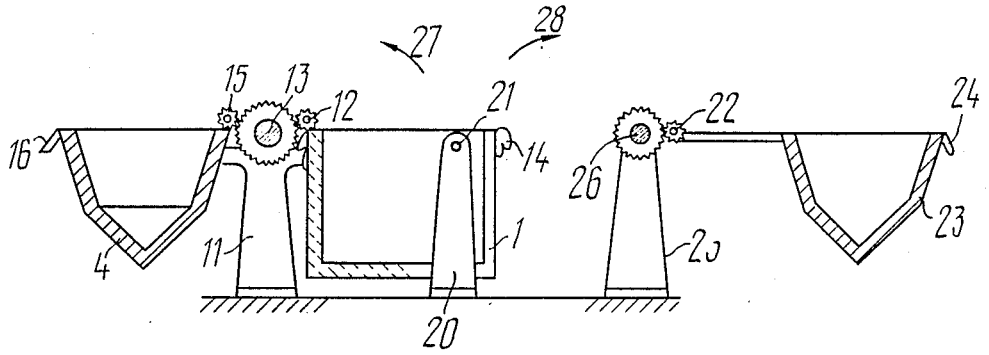
FIG. 9 shows an embodiment of the invention with a multistation device, according to the invention.

In the proposed embodiment of a multistation device the mold 4 (FIG. 9) is mounted on a common pivot bearing 11 and is provided with an individual drive 15 for turning the mold in a vertical plane about the center point 13 of the common pivot bearing 11. The reservoir 1 is hingedly mounted between the bearings 11 and 20 with a possibility of occupying two positions. In one position the reservoir 1 is connected to the bearing 11 and is capable of turning in a vertical plane about the center point 13 of the common pivot bearing 11 by means of the drive 12. In the other position the reservoir 1 is connected to the bearing 20 and is capable of turning in a vertical plane about the center 21 of the common pivot bearing 20 by means of a drive 22. Mounted to the other side of the reservoir 1 is an additional mold 23 having elements 24 for coupling the mold to the reservoir 1. This additional mold is mounted on an individual pivot bearing 25 and is capable of turning in a vertical plane about the center point 26 of the common pivot bearing 25 by means of the drive 22. The multistation device may include a larger amount of additional molds disposed at different sides of the reservoir 1. The arrows 27 and 28 show the direction of rotation of the reservoir 1 together with the molds 4 and 23 respectively.

The proposed device for producing shaped castings in a mold operates as follows.

At the beginning of the working cycle, the upper end faces of the reservoir 1 (FIG. 6) and mold 4 are turned through 180° relative to each other. The molten metal 2 and the slag 3 are obtained in the reservoir 1, e.g. by means of electroslag remelting of the consumable electrode 5. After that the mold 4 (FIG. 7) is rotated through an angle of 180° about the center point 13 of the common pivot bearing 11 until its upper end face adjoins the upper end face of the reservoir 1. When the mold 4 approaches the reservoir 1, the elements 16 of the mold 4 made in the form of clamps engage the elements 14 of the reservoir 1 made in the form of skewed brackets so that a closed integrated unit 18 is formed. This position being an initial step of pouring the molten metal 2 and the slag 3 into the mold 4. After that, the integrated closed unit 18 is rotated by the drive 12 about the center point 13 of the common pivot bearing 11 through 180° in the direction shown by the arrow 19 (FIG. 8). The slow rotation of the reservoir 1 with the mold 4 results in laminar pouring of the molten metal 2 into the mold 4 under a layer of the slag 3. In so doing, a casting 7 starts being formed in the mold 4 under the layer of the slag 3. Then the mold 4 with the casting 7 is disconnected from the reservoir 1 and the latter is returned to its initial position without waiting for installation of a fresh mold 4. A next portion of the metal 2 and the slag 3 is obtained in the reservoir 1, i.e. the cycle is repeated.

Should it be necessary to heat the casting head 8 of the casting 7 utilizing the radiant energy 9 radiated by the inner surface 10 of the reservoir 1, the latter is kept on the mold 4 until the casting 7 is completely crystallized, the crystallization process being monitored, for example, by a thermocouple.

When, for example, two molds 4 and 23 are used (FIG. 9), the device operates as follows. After the metal 2 and the slag 3 are obtained in the reservoir 1, the upper end face thereof adjoins the upper end face of the mold 4 and they are fixed in position by means of the elements 14 and 16, the reservoir 1 is disconnected from the bearing 20. Then the reservoir 1 together with the mold 4 secured thereon is rotated by the drive 12 about the center point 13 of the pivot bearing 11 in the direction shown by the arrow 27. In so doing, the metal 2 with the slag 3 (FIG. 5) are poured into the mold 4. After that the reservoir 1 (FIG. 9) is disconected from the mold 4, returned to its initial position and fixed on the bearing 20. Then a next portion of the metal 2 (FIG. 1) and the slag 3 is produced, the upper end faces of the mold 23 (FIG. 9) and the reservoir 1 are made to adjoin each other and the mold 23 is fixed on the reservoir 1

By means of the elements 14 and 24. Thereupon the reservoir 1 is disconnected from the bearing 11 and rotated together with the mold 23 secured thereon through 180° about the center 21 of the bearing 20 by means of the drive 22. In doing so, the molten metal 2 and the slag 3 are being poured into the mold 23. The reservoir 1 is disconnected from the mold 23, returned to its initial position and the working cycle is repeated.

Thus, the use of the present invention makes it possible to produce the castings 7 featuring high quality (FIGS. 5, 8) without blow holes and other casting defects. The delayed pouring of the molten metal 2 and the slag 3 into the mold 4 eliminates spillage of the metal 2 with the slag 3 in the process of their pouring into the mold 4. This delay is possible due to the fact that the reservoir 1 and the mold 4 are provided with the individual drives, 12 and 15 respectively, one of which imparts rotation to the mold 4 until the upper end faces of the mold 4 and the reservoir 1 adjoin and form the integrated unit 18, while the other drive turns the unit 18 in the process of pouring. Furthermore, the individual drives 12 and 15 for the mold 4 and the reservoir 1 make it possible to obtain a next portion of the molten metal 2 and the slag 3 in the reservoir 1 by disconnecting thereof from the mold 4 prior to complete crystallization of the casting 7 thus increasing the device efficiency. Keeping the reservoir 1 above the mold 4 and heating the casting head 8 of the casting 7 in the process of its crystallization by the radiant energy 9 radiated from the inner surface of the reservoir 1 enhence the quality of the casting 7 with significant rise of the process efficiency due to reduction of the amount of flux used for heating the casting head 8 of the casting 7.

We claim:

1. A method of producing shaped castings in a mold, comprising the following steps:

installing a mold and a reservoir in an initial position, in which their upper end faces are arranged at an angle of 180° to one another;

obtaining molten metal and slag in said reservoir;

rotating said mold 180° about the center point of a common pivot bearing with said reservoir so that said mold is above said reservoir so that their upper end faces adjoin each other and form a joint;

transferring said molten metal and slag into said mold, thus effecting a process of pouring them from said reservoir by simultaneous joint rotation of said mold and reservoir to a position, in which said reservoir is placed above said mold;

sealing tightly said joint of said upper end faces during said process of pouring;

crystallizing said molten metal and slag in said mold until a shaped casting having a casting head is produced.

2. A method of producing shaped castings in a mold according to claim 1, in which the joint of said upper end faces of said mold and said reservoir is sealed by means of time delay of said process of pouring from the moment of putting said layer of slag on said joint till the moment of solidification of said layer of slag.

3. A method of producing shaped castings in a mold according to claim 2, in which the time delay of said process of pouring is taken to be not less than two per cent of the total duration of said pouring.

4. A method of producing shaped castings in a mold according to claim 1, in which said reservoir is kept on said mold until complete crystallization of said casting takes place.

5. A method of producing shaped castings in a mold according to claim 2, in which said layer of slag covering said joint of said upper end faces of said mold and reservoir is forcedly cooled.

6. A device for producing shaped castings in a mold comprising:

a reservoir for molten metal and slag and having an upper end face;

a drive for rotating said reservoir for molten metal and slag;

a mold having an upper end face and mounted with a possibility of moving toward said reservoir for molten metal and slag until said upper end face of said reservoir adjoins said upper end face of said mold, said upper end faces of said reservoir for molten metal and slag and of said mold forming upon adjoining a closed integrated unit consisting of said reservoir for molten metal and slag and said mold and said integrated unit being rotated in a vertical plane by said drive;

a first pivot bearing and said reservoir for molten metal and slag and said mold mounted on said first pivot bearing;

a drive mounted on said mold for turning said mold in a vertical plane;

a second pivot bearing and said reservoir for molten metal and slag fixed in between said first pivot bearing and said second pivot bearing with a possibility of occupying positions, in one of which it is connected to said first pivot bearing and in a second position it is connected to said second pivot bearing;

at least one additional pivot bearing;

at least one additional mold mounted on said additional pivot bearing and having an upper end face; and at least one additional drive mounted on said additional mold for turning the additional mold in a vertical plane, said upper end faces of said reservoir for molten metal and slag and said additional mold forming in one position of said reservoir for molten metal and slag a close integrated unit, consisting of said reservoir for molten metal and slag and said additional mold and said integrated unit being rotatable in a vertical plane by means of said drive of said reservoir for molten metal and slag.

7. A device for producing shaped castings in a mold according to claim 6, wherein said reservoir for molten metal and slag, said mold and said additional mold are provided with at least one automatic coupling element operating in the process of adjoining said upper end faces of said reservoir for molten metal and slag, said mold and said additional mold.

* * * * *